US005630544A

United States Patent [19]

Shane

[11] Patent Number: 5,630,544

[45] Date of Patent: May 20, 1997

[54] FOOD PRODUCTS CONTAINER WITH POCKET

[76] Inventor: Penny K. Shane, 10214 W. State Rte. 12, Fostoria, Ohio 44830

[21] Appl. No.: 519,297

[22] Filed: Aug. 25, 1995

[51] Int. Cl.[6] ..... B65D 5/36

[52] U.S. Cl. ..... 229/117.06; 229/114; 229/120.01; 229/120.08; 229/405; 229/906

[58] Field of Search ..... 229/114, 117.05, 229/117.06, 120.01, 120.08, 164, 400, 405, 902, 904, 906; 426/115; 220/23.83; 383/38, 40, 113

[56] References Cited

U.S. PATENT DOCUMENTS

| | | | |
|---|---|---|---|
| D. 47,085 | 3/1915 | Veith . | |
| 1,220,793 | 3/1917 | Spector . | |
| 1,255,133 | 2/1918 | Carr | 229/405 |
| 1,666,704 | 4/1928 | Hunter . | |
| 2,083,860 | 6/1937 | Offenbacher . | |
| 2,189,431 | 2/1940 | Moore | 383/113 |
| 2,654,527 | 10/1953 | Geckler et al. . | |
| 2,917,164 | 12/1959 | Kehr . | |
| 3,339,824 | 9/1967 | Luke | 383/38 |
| 3,456,866 | 7/1969 | Civitello . | |
| 3,693,868 | 9/1972 | Rich . | |
| 3,797,734 | 3/1974 | Fleury et al. . | |
| 3,804,323 | 4/1974 | Bemel . | |
| 4,081,125 | 3/1978 | Meyers | 229/120.18 |
| 4,086,945 | 5/1978 | Carter | 383/38 |
| 4,126,261 | 11/1978 | Cook | 229/904 |
| 4,127,155 | 11/1978 | Hydorn | 383/113 |
| 4,299,324 | 11/1981 | Dickens | 383/38 |
| 4,407,442 | 10/1983 | Watson et al. | 229/120.18 |
| 4,468,933 | 9/1984 | Christopher . | |
| 4,854,466 | 8/1989 | Lane, Jr. | 220/23.83 |
| 4,955,528 | 9/1990 | Schluckebier | 229/902 |
| 4,991,980 | 2/1991 | Cohen et al. . | |
| 4,993,845 | 2/1991 | Faltynek . | |
| 5,035,515 | 7/1991 | Crossman et al. . | |
| 5,149,202 | 9/1992 | Dickert . | |

FOREIGN PATENT DOCUMENTS

| | | | |
|---|---|---|---|
| 642389 | 10/1993 | Australia | 229/904 |
| 1486368 | 4/1969 | Germany | 383/40 |
| 83445 | 4/1954 | Norway | 383/40 |
| 849686 | 9/1960 | United Kingdom | 383/40 |

*Primary Examiner*—Gary E. Elkins
*Attorney, Agent, or Firm*—MacMillan, Sobanski & Todd

[57] ABSTRACT

This invention relates to a collapsible container for holding food products having an attached collapsible pocket for holding condiments. The container has a flat, rectangular bottom and tapered front and rear walls connected thereto. Tapered side walls are joined to the bottom and connected between the front and rear walls. The width of the tapered front and rear walls and the tapered side walls increases as they extend upwardly from the bottom to form an opening at the top of the container. The area of the opening is larger than the area of the rectangular bottom. A collapsible pocket having a rectangular bottom is secured to the outside of the front wall of the collapsible container. The pocket has a rectangular front wall spaced apart from the container by a pair of rectangular side walls and a flat, rectangular pocket bottom. The container and pocket collapse by folding flat for compact storage.

21 Claims, 2 Drawing Sheets

FOOD PRODUCTS CONTAINER WITH POCKET

BACKGROUND OF THE INVENTION

This invention relates in general to flexible containers for holding food products and in particular to a collapsible paper container having a collapsible side pocket for holding the condiment catsup.

Restaurants must package the food sold to customers, and containers of all shapes and sizes are commonly used. Small containers are used to hold an individual serving, such as a medium order of French fried potatoes ("fries"), while larger containers hold the customer's entire order. These containers are usually collapsible so they can be folded and stored flat to save space prior to being used.

A customer typically receives the condiment catsup with a food order. A serving of fries may be accompanied by catsup. Unfortunately, the containers which hold the fries do not provide a convenient storage space for this condiment, and the customer must rummage through the container containing the entire order usually finding the condiment lying at the bottom of the container. Accordingly, it would be desirable to provide an improved collapsible single-serving container which would provide a convenient storage space for the condiment catsup.

SUMMARY OF THE INVENTION

This invention relates to a collapsible container for holding food products having an attached collapsible pocket for holding the condiment catsup. The container has a flat, rectangular bottom and tapered front and rear walls connected thereto. Tapered side walls are joined to the bottom and connected between the front and rear walls. The width of the tapered front and rear walls and the tapered side walls increases as they extend upwardly from the bottom to form an opening at the top of the container. The area of the opening is larger than the area of the rectangular bottom. A collapsible pocket having a rectangular bottom is secured to the outside of the front wall of the collapsible container. The pocket has a rectangular front wall spaced apart from the container by a pair of rectangular side walls and a flat, rectangular pocket bottom. The container and pocket collapse by folding flat for compact storage.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
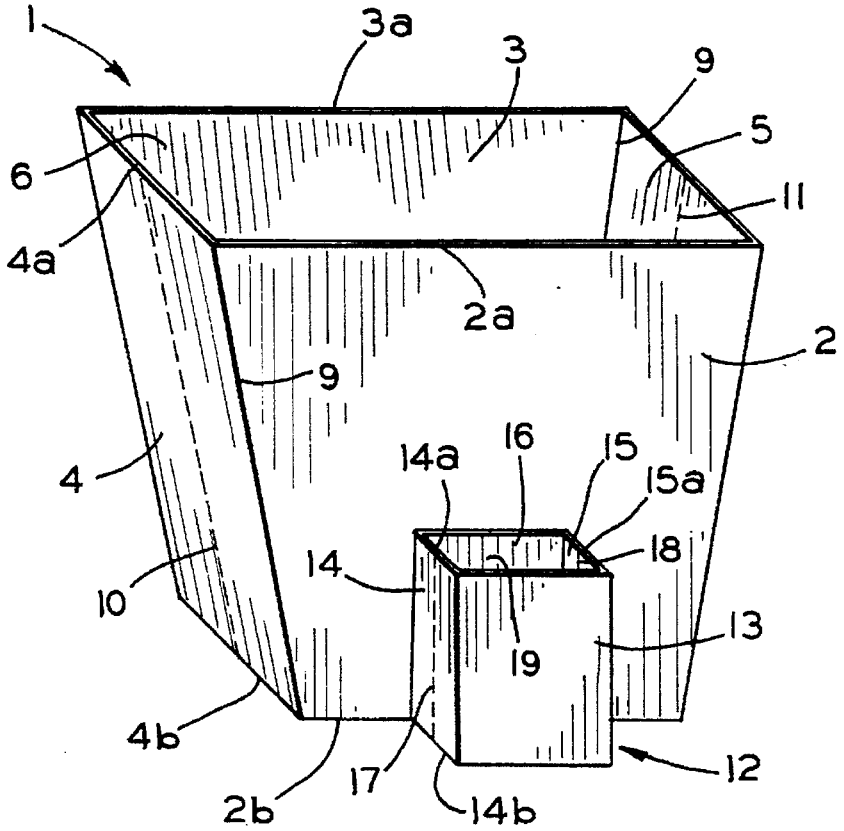
FIG. 1 is a front view in perspective illustrating the container with collapsible side pocket.

Referring now to the drawings, there is illustrated in FIG. 1 a container for holding a food product indicated generally at 1. The container has a front wall 2, a rear wall 3, a flat, rectangular bottom (7 in FIG. 3) and sides 4 and 5.

The front and rear walls 2 and 3 are joined to the sides 4 and 5 along the four corner edges 9. The bottom of the front wall **2*b* and the rear wall 3*b* and the bottom of the sides 4*b* and 5*b* are joined to the bottom of the container 1. The from and rear walls 2 and 3 and the sides 4 and 5 are tapered and extend upwardly and terminate at the top opening 6. The tops of the front wall 2*a* and rear wall 3*a* are wider than the bottoms of the front wall 2*b* and rear wall 3*b* respectively, and therefore the distance between the sides 4 and 5 increases as the sides extend upwardly from the bottom 7**.

Figure 2:
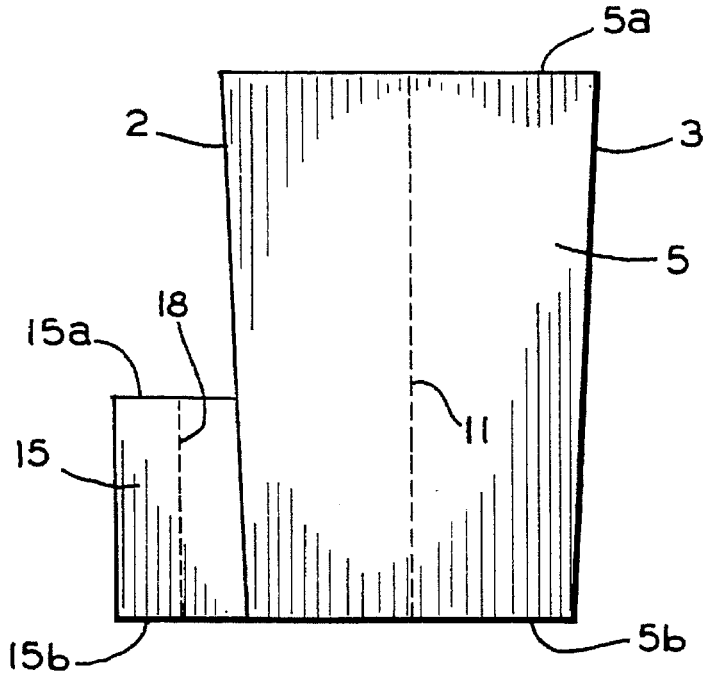
FIG. 2 is a side view of the container and side pocket illustrated in FIG. 1.

The tapered sides are shown in FIG. 2. The top of the sides **4*a* and 5*a* is wider than the bottom of the sides 4*b* and 5*b* and the distance between the front wall 2 and the rear wall 3 increases as the front wall 2 and the rear wall 3 extend upwardly from the bottom 7. The area of the opening 6 is greater than the area of the bottom 7. The sides 4 and 5 have center folds 10 and 11 that extend from the top of the sides 4*a* and 5*a* to the bottom of the sides 4*b* and 5*b*** respectively.

A pocket shown generally at 12 is provided. The pocket has a rectangular front wall 13, generally rectangular side walls 14 and 15, a flat, rectangular bottom (8 in FIG. 3), a rectangular rear wall 16, and a top opening 19. The rear wall 16 is attached to the front wall 2 of the container 1. Alternately, a separate pocket rear wall may not be used. Instead, the pocket sides 14 and 15 may be secured to the container 1 so that the from wall 2 of the container forms the pocket rear wall 16. While the pocket can be placed anywhere on the front wall of the container 1, it is desirable that it be positioned low enough to keep the container's center of gravity low to keep the container standing upright. The pocket can be positioned so that when unfolded, the flat pocket bottom and the bottom of the container form a plane to provide maximum stability in keeping the container in an upright position. The pocket sides 14 and 15 have center folds 17 and 18 that extend from the top of the pocket sides **14*a* and 15*a* to the bottom of the sides 14*b* and 15*b*** respectively.

The pocket can be water-resistant to hold the condiment catsup without leaking or soaking through. Suitable materials may be paper stock, coated paper, plastic, foil or foil-covered paper. The material used must be flexible enough to allow the container and pocket to be collapsible.

The pocket is appropriately sized to hold the condiment. The volume of the pocket can range from 0.5 to 40 cubic inches, although a typical range is 2 to 5 cubic inches. The pocket opening 19 is sized so that the food product can be dipped into the condiment held by the pocket. The pocket opening can have an area ranging from 0.5 to 10 square inches, although a typical range is 1 to 5 square inches.

Figure 3:
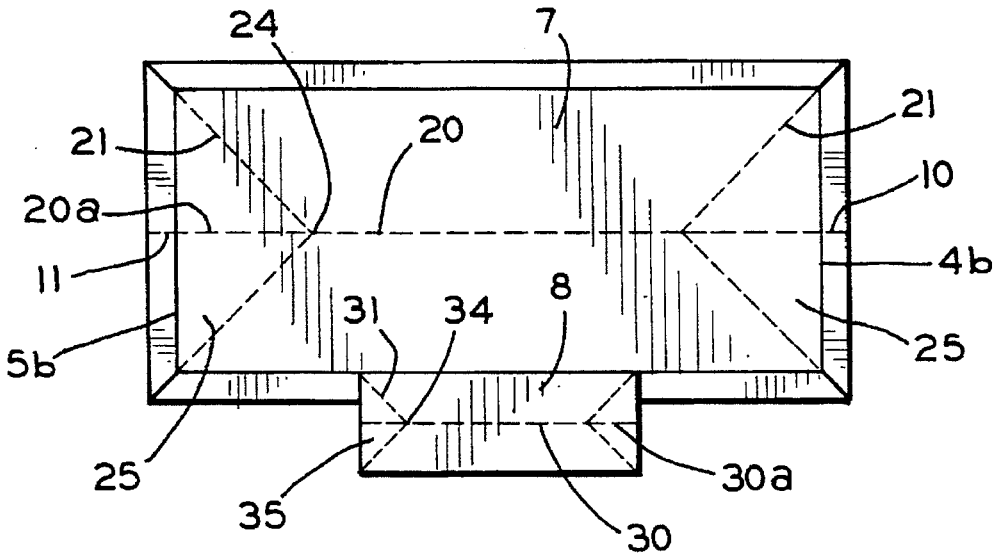
FIG. 3 is a bottom view of the container and side pocket illustrated in FIG. 1.

The bottom 7 of the container, shown in FIG. 3, has a center fold 20 which extends from the bottom of one side **4*b* to the bottom of the other side 5*b*. The bottom 7 also has four angular folds 21 which extend from each corner of the bottom to the bottom center fold 20 forming an apex 24. A triangular bottom section 25 is formed on opposite ends of the bottom between the angular folds 21 and the bottom of both sides 4*b* and 5*b*. The bottom center fold 20 has end sections 20*a* which extend between the apex 24 and the bottom of each side 4*b* and 5*b* and bisect each triangular section 25**.

Similarly the bottom of the pocket 8 has a center fold 30 which extends from the bottom of one pocket side **14*b* to the bottom of the other pocket side 15*b*. The pocket bottom 8 also has four angular folds 31 which extend from each corner of the pocket bottom to the pocket bottom center fold 30 forming an apex 34. A triangular bottom section 35 is formed on opposite ends of the pocket bottom between the angular folds 31 and the bottom of both sides 4b and 5b. The bottom center fold 30 has end sections 30a which extend between the apex 34 and the bottom of each side 14b and 15b and bisect each triangular section 35**.

Figure 4:
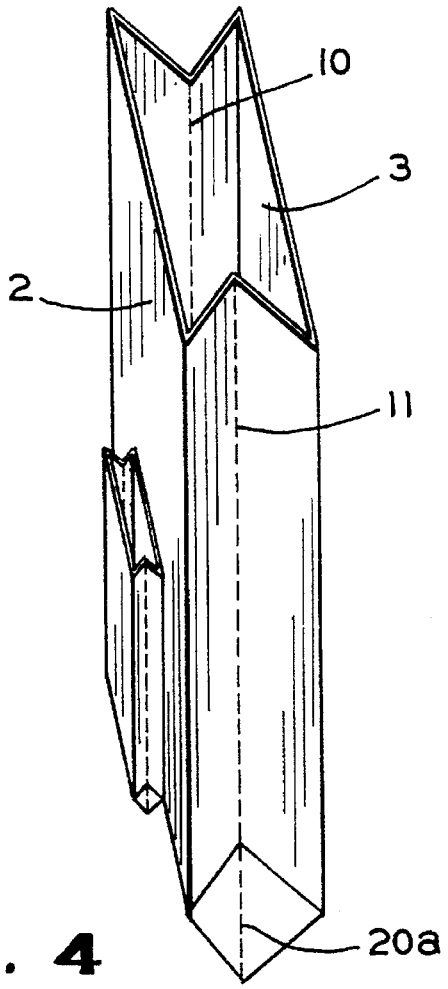
FIG. 4 is a side elevational view of the container and side pocket illustrated in FIG. 1 folded.

The container can be collapsed as shown in FIG. 4. The front and rear walls 2 and 3 are brought together by folding the sides at the center folds 10 and 11 which move inward towards the interior of the container. The bottom 7 is folded outwards along the bottom center fold 20, but the bottom center fold end sections 20a are folded inwards similar to the side center folds 10 and 11. As the front and rear walls are brought together, the sides 4 and 5 and the triangular bottom sections 25 are folded in half along the side center folds 10 and 11 and the bottom center fold end sections 20a respectively.

The pocket can also be collapsed in an identical manner. The front and rear pocket walls 13 and 16 are brought together by folding the pocket sides 14 and 15 at the center folds 17 and 18 which move inward towards the interior of the pocket. The pocket bottom 8 is folded outwards along the bottom center fold 30, but the bottom center fold end sections 30a are folded inwards similar to the side center folds 17 and 18. As the front and rear walls are brought together, the sides 14 and 15 and the triangular bottom sections 35 are folded in half along the side center folds 17 and 18 and the bottom center fold end sections 30a respectively. The collapsed container and pocket can be pressed flat for compact storage.

In accordance with the provisions of the patent statutes, the principle and mode of operation of the present invention have been explained and illustrated in the preferred embodiment, however, it will be understood that the present invention may be practiced otherwise than as specifically explained and illustrated without departing from its spirit or scope.

What is claimed is:

1. A collapsible container for holding food products comprising:

a flat rectangular bottom;

a front wall having a top and a bottom, said front wall bottom joined to said flat bottom, said front wall top being wider than said front wall bottom;

a rear wall spaced apart from said front wall having a top and a bottom, said rear wall bottom joined to said flat bottom, said rear wall top being wider than said rear wall bottom;

a first side wall having a top and a bottom, said first side wall joined to said front wall and said rear wall, said first side wall bottom joined to said flat bottom, said first side wall top being wider than said first side wall bottom;

a second side wall having a top and a bottom, said second side wall joined to said front wall and said rear wall, said second side wall bottom joined to said flat bottom, said second side wall top being wider than said second side wall bottom, said front wall, rear wall, first side wall, second side wall and bottom forming said container having a top opening which is larger than the area of said bottom when said container is in a non-collapsed position; and a collapsible pocket attached to said front wall of said container, said pocket including a flat pocket bottom joined to said front wall of said container, a pocket front wall spaced apart from said front wall of said container and extending upwards from said pocket bottom, and a pair of pocket side walls extending upwards from said pocket bottom and joining said front pocket wall and said front wall of said container to form a pocket opening, said pocket being smaller in size than said container such that said container is sized to hold the food product while said pocket is sized to hold a condiment suitable for the food product.

2. The invention disclosed in claim 1 wherein said pocket further includes a pocket rear wall attached to said front wall of said container, said pocket front wall being spaced apart from said pocket rear wall, said pair of pocket side walls being joined to said pocket rear wall and to said pocket front wall to form said pocket opening.

3. The invention disclosed in claim 1 wherein said pocket is water resistant.

4. The invention disclosed in claim 1 wherein said pocket is sized between 0.5 and 40 cubic inches to hold the condiment catsup.

5. The invention disclosed in claim 4 wherein said pocket opening is sized between 0.5 and 10 square inches.

6. The invention disclosed in claim 1 wherein said container top opening is open when said container front wall, rear wall, first side wall, second side wall and bottom are in said non-collapsed position, said pocket top opening is open when said pocket front wall, pair of side walls and bottom are in a non-collapsed position, and said container bottom and said pocket bottom lie flat when said container and said pocket are in their non-collapsed positions.

7. The invention disclosed in claim 1 wherein said container top opening is open when said container front wall, rear wall, first side wall, second side wall and bottom are in said non-collapsed position, said pocket top opening is open when said pocket front wall, pair of side walls and bottom are in a non-collapsed position, and said container bottom and said pocket bottom lie in a plane when said container and said pocket are in their non-collapsed positions.

8. A collapsible container for holding food products having:

a flat rectangular bottom;

a front wall having a top and a bottom, said front wall bottom joined to said bottom, said front wall top being wider than said front wall bottom;

a rear wall spaced apart from said front wall having a top and a bottom, said rear wall bottom joined to said bottom, said rear wall top being wider than said rear wall bottom;

a first side wall having a top and a bottom, said first side wall joined to said front wall and said rear wall, said first side wall bottom joined to said bottom, said first side wall top being wider than said first side wall bottom;

a second side wall having a top and a bottom, said second side wall joined to said front wall and said rear wall, said second side wall bottom joined to said bottom, said second side wall top being wider than said second side wall bottom, wherein said front wall, rear wall, first side wall, second side wall and bottom form said container having a top opening which is larger than the area of said bottom, said first and second side walls each having a fold and said bottom having a plurality of folds adapted for folding said container into a collapsed position wherein said top opening of said container is closed and for unfolding said container into a non-collapsed position wherein said top opening of said container is open; and a collapsible water-resistant pocket for holding a condiment, said pocket being attached to said front wall of said container, said pocket including a pocket bottom joined to said front wall of said container, a pocket front wall spaced apart from said front wall of said container and extending upwards from said pocket bottom, and a pair of pocket side walls extending upwards from said pocket bottom and joining said front pocket wall and said front wall of said container to form a pocket opening, said pair of pocket sidewalls each having a fold and said pocket bottom having a plurality of folds adapted for folding said pocket into a collapsed position wherein said pocket opening is closed and for unfolding said pocket into a non-collapsed position wherein said pocket opening is open, said pocket being smaller in size than said container such that said container is sized to hold the food product while said pocket is sized to hold a condiment suitable for the food product.

9. The invention disclosed in claim 8 wherein said pocket further includes a pocket rear wall attached to said front wall of said container, said pocket front wall being spaced apart from said pocket rear wall, said pair of pocket side walls being joined to said pocket rear wall and to said pocket front wall to form said pocket opening.

10. The invention disclosed in claim 8 wherein said container bottom and said pocket bottom are flat when said container and said pocket are unfolded to their non-collapsed position.

11. The invention disclosed in claim 9 wherein said container bottom and said pocket bottom form a plane when said container and said pocket are unfolded to their non-collapsed position.

12. The invention disclosed in claim 8 wherein said pocket is sized between 0.5 and 40 cubic inches.

13. The invention disclosed in claim 12 wherein said pocket opening is sized between 0.5 and 10 square inches.

14. The invention disclosed in claim 8 wherein said container is water resistant.

15. A collapsible container for holding food products comprising:

a bottom;

a front wall having a top and a bottom, said front wall bottom joined to said bottom, said front wall top being wider than said front wall bottom;

a rear wall spaced apart from said front wall having a top and a bottom, said rear wall bottom joined to said bottom, said rear wall top being wider than said rear wall bottom;

a first side wall having a top and a bottom, said first side wall joined to said front wall and said rear wall, said first side wall bottom joined to said bottom, said first side wall top being wider than said first side wall bottom;

a second side wall having a top and a bottom, said second side wall joined to said front wall and said rear wall, said second side wall bottom joined to said bottom, said second side wall top being wider than said second side wall bottom, said front wall, rear wall, first side wall, second side wall and bottom forming said container having a top opening which is larger than the area of said bottom when said container is in a non-collapsed position; and a collapsible pocket for holding a condiment, said pocket being attached to said front wall of said container, said pocket having a pocket bottom joined to said front wall of said container, a pocket front wall spaced apart from said front wall of said container and extending upwards from said pocket bottom, and a pair of pocket side walls extending upwards from said pocket bottom and joining said front pocket wall and said front wall of said container to form a pocket opening of 0.5 to 10 square inches when said pocket is in a non-collapsed position, said pocket having a volume of 0.5 to 35 cubic inches, said pocket being smaller in size than said container such that said pocket is sized for holding the condiment catsup while said container is sized for holding the food product.

16. The invention disclosed in claim 15 wherein said pocket further includes a pocket rear wall attached to said front wall of said container, said pocket front wall being spaced apart from said pocket rear wall, said pair of pocket side walls being joined to said pocket rear wall and said pocket front wall to form said pocket opening.

17. The invention disclosed in claim 15 wherein said pocket is water resistant.

18. The invention disclosed in claim 15 wherein said pocket has a volume between 2 and 5 cubic inches.

19. The invention disclosed in claim 15 wherein said pocket opening has an area between 1 and 5 square inches.

20. The invention disclosed in claim 15 wherein said container top opening is open when said container front wall, rear wall, first side wall, second side wall and bottom are in said non-collapsed position, said pocket top opening is open when said pocket front wall, pair of side walls and bottom are in said non-collapsed position, and said container bottom and said pocket bottom lie flat when said container and said pocket are in their non-collapsed positions.

21. The invention disclosed in claim 15 wherein said container top opening is open when said container front wall, rear wall, first side wall, second side wall and bottom are in said non-collapsed position, said pocket top opening is open when said pocket front wall, pair of side walls and bottom are in said non-collapsed position, and said container bottom and said pocket bottom lie in a plane when said container and said pocket are in their non-collapsed positions.

* * * * *